US007407427B2

(12) United States Patent
Liu

(10) Patent No.: US 7,407,427 B2
(45) Date of Patent: Aug. 5, 2008

(54) BRASSIERE

(75) Inventor: Zhen Qiang Liu, Kwai Chung (HK)

(73) Assignee: Regina Miracle International Ltd., Hong Kong (HK)

( * ) Notice: Subject to any disclaimer, the term of this patent is extended or adjusted under 35 U.S.C. 154(b) by 104 days.

(21) Appl. No.: 11/437,149

(22) Filed: May 19, 2006

(65) Prior Publication Data

US 2007/0281584 A1 Dec. 6, 2007

(51) Int. Cl.
*A41C 3/10* (2006.01)
*A41C 3/00* (2006.01)

(52) U.S. Cl. ..... 450/39; 450/92; 450/93

(58) Field of Classification Search ..... 450/39, 450/92, 93, 37, 38, 54–58; 2/243.1, 267, 2/268; 156/77–79, 242, 246; 264/464, 466
See application file for complete search history.

(56) References Cited

U.S. PATENT DOCUMENTS

| | | | | |
|---|---|---|---|---|
| 2,727,278 | A * | 12/1955 | Thompson | 264/46.4 |
| 3,202,565 | A * | 8/1965 | Loftin | 428/175 |
| 3,772,899 | A * | 11/1973 | Novi | 66/176 |
| 6,425,800 | B1 * | 7/2002 | Huang | 450/41 |
| 6,645,040 | B2 * | 11/2003 | Rabinowicz et al. | 450/1 |
| 6,805,610 | B2 | 10/2004 | Luk | 450/54 |
| 6,811,464 | B2 * | 11/2004 | Li | 450/57 |
| 6,837,771 | B2 * | 1/2005 | Falla | 450/39 |
| 7,131,888 | B2 * | 11/2006 | Hsu | 450/39 |
| 7,179,150 | B2 * | 2/2007 | Luk et al. | 450/39 |
| 7,192,332 | B2 * | 3/2007 | Liu | 450/39 |
| 2004/0224604 | A1 | 11/2004 | Luk | 450/39 |

FOREIGN PATENT DOCUMENTS

| | | |
|---|---|---|
| DE | 101 44 240 | 4/2003 |
| EP | 1 656 843 A2 | 5/2006 |
| JP | 2000-34604 | 2/2000 |
| JP | P2004-263315 | 9/2004 |

* cited by examiner

*Primary Examiner*—Gloria Hale
(74) *Attorney, Agent, or Firm*—Ostrolenk, Faber, Gerb & Soffen, LLP

(57) ABSTRACT

A brassiere which comprises two molded and seamless breast cups and at least one chest band to hold the bra to a user of the brassiere, wherein the chest band includes as least one panel of material which is affixed to one or both of the breast cups and the panel of material does not extend across any part of the molded and seamless breast cups.

30 Claims, 6 Drawing Sheets

BRASSIERE

FIELD OF THE INVENTION

The present invention relates to a brassiere comprised of an assembly of plies of material.

BACKGROUND OF THE INVENTION

Our earlier patent application US2004/0224604 describes a molded brassiere (hereinafter referred to as "bra") wherein the bra consists of an assembly of plies that have been molded and laminated to each other to define a bra or component for a bra. More specifically our earlier patent application describes a bra that includes a core assembly and outer and inner layers encasing the core assembly. The inner and outer layers encase the core assembly and also extend beyond the core assembly to define the chest bands of a bra. The earlier patent application describes that the inner and outer layers each preferably consists of an assembly of plies comprising of a fabric layer laminated with a foam layer. The foam layers of each of the inner and outer layers are presented towards each other so that the fabric layer is presented outermost on each of the inner and the outer facing surfaces of the bra. A bra that may be manufactured according to the invention described in our earlier patent application may result in the chest bands of the bra including the foam ply. However this may not in all circumstances or by all end users, be a desirable result. It may be desirable especially during summer seasons or in hotter climates, for minimal foam to be present in a bra. A foam ply enhances shaping and form integrity of a bra but such may be undesirable from a comfort point of view to the end user.

Being limited to having a chest band that includes at least some of the plies of material that also extend across the core assembly or the bra cup region to define the chest band can also limit flexibility in appearance and finish.

Accordingly it is an object of the present invention to provide a substantially molded bra having a foam-incorporating molded core assembly with a chest band that includes a ply or plies of material separately affixed to part of the core assembly, and in particular to provide such a bra wherein the chest band or bands may predominantly be absent of a foam ply or plies, or to at least provide the public with a useful choice.

BRIEF DESCRIPTION OF THE INVENTION

Accordingly in a first aspect the present invention consists in a brassiere defined in part by an assembly of a plurality of panels of material, the assembly generally defining two breast cup regions, a bridge region between the two breast cup regions, and at least a chest band which comprises one or more plies of material and which extends from at least one of the two breast cups, wherein the assembly includes:

a. a core assembly which substantially defines the two breast cup regions and the bridge region, the core assembly comprising at least an inner ply of molded foam material and an outer ply of molded foam material laminated with the inner ply of molded foam material, b. a first panel of material which is affixed to part of the core assembly and which substantially forms the ply of material or one or more of the plies of material making up the chest band, and c. a second panel of material which is affixed to and overlaps at least part of the core assembly including the region where the first panel of material is affixed to the core assembly.

Preferably the second panel of material does not extend across the entire length of the chest band.

Preferably the second panel of material extends across one-half or less of the entire length of the chest band.

Preferably the first panel of material comprises at least one ply of fabric material.

Preferably the first panel of material is exclusively fabric material.

Preferably the first panel of material is affixed to the core assembly at part of the periphery of the core assembly.

Preferably the first panel of material is affixed to the core assembly at or near an or part of an edge of the first panel of material.

Preferably the first panel of material is affixed to the core assembly by stitching.

Preferably the first panel of material is affixed to the core assembly by an adhesive means.

Preferably the first panel of material is affixed to the core assembly by means of heat or ultrasonic welding.

Preferably the breast cup regions are seamless.

Preferably the core assembly is seamless.

Preferably the core assembly further comprises an underwire sandwiched between the inner ply of molded foam material and the outer ply of molded foam material at the lower peripheral region of a breast cup region.

Preferably the first panel of material comprises two contiguous plies of fabric material substantially laminated with each other.

Preferably two first panels of material are provided, each being affixed to a respective breast cup region of the core assembly, each such first panel of material including a free end that carries a clasp to cooperate with the clasp of the other first panel of material to join the two first panels together to in use hold the brassiere to the chest of the user, and wherein the second panel of material overlaps at least part of each of the first panels including the region where each first panel is affixed to the core assembly.

Preferably two second panels of material are provided, one being affixed to the outer side of the core assembly and the other being affixed to the inner side of the core assembly.

Preferably the second panel of material comprises at least one ply of fabric material.

Preferably the second panel of material comprises a foam ply and a fabric ply laminated with the foam ply, wherein the fabric ply is positioned more distal to the core assembly than the foam ply.

Preferably the second panel of material overlaps the entire inner or outer surface of the core assembly.

Preferably the second panel of material is laminated to the core assembly.

Preferably the second panel of material is on the outer side of the brassiere.

Preferably the second panel of material is on the inner side of the brassiere.

Preferably a substantial portion of the edge of the brassiere is ultrasonically welded.

Preferably an outermost ply of fabric material is disposed to the outer side of the brassiere and extends across both the core assembly and the first panel of material.

Preferably the outermost ply of fabric material is affixed to the inner side of the brassiere by folding the edge of the outermost ply and affixing the folded-over edge to the inner side of the brassiere.

Preferably the affixing of the folded-over edge to the inner side of the brassiere is by adhesive means.

Preferably an inner most ply of fabric material is disposed to the inner side of the brassiere and extends across both the core assembly and the first panel of material.

Preferably the core assembly is unitary.

Preferably the core assembly is of two parts, each part defining one of the breast cup regions and each part connectable together at the bridge region, the brassiere so defined being of a front opening kind.

In a second aspect the present invention consists in a brassiere which comprises two molded and seamless breast cups and at least one chest band to hold the bra to a user of the brassiere, wherein the chest band includes as least one panel of material which is affixed to one or both of the breast cups and the panel of material does not extend across any part of the molded and seamless breast cups.

BRIEF DESCRIPTION OF THE DRAWINGS

Preferred embodiments of the present invention will now be described with reference to the accompanying drawings in which.

DETAILED DESCRIPTION OF THE PREFERRED EMBODIMENTS

Figure 1A:
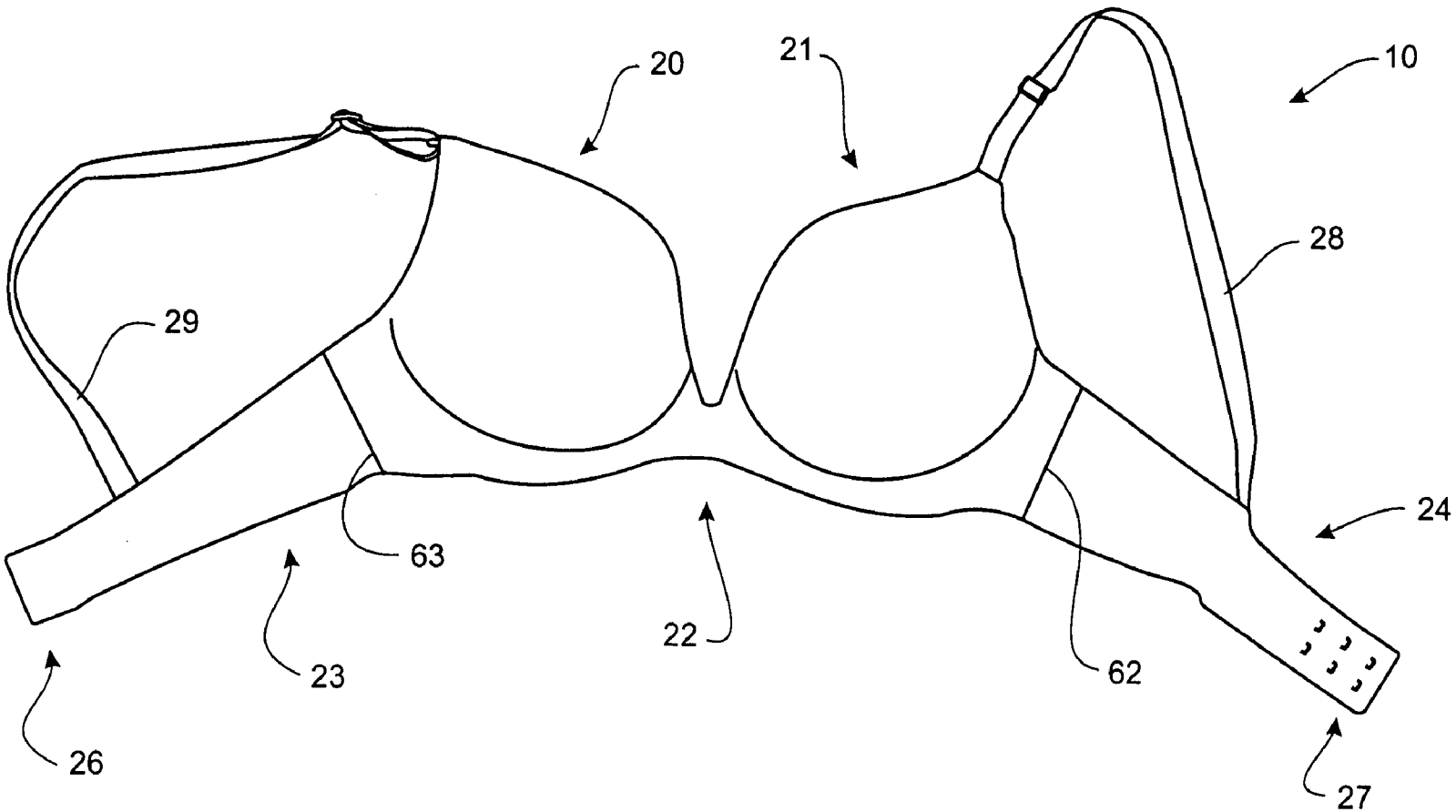
FIG. 1*a* is a front view of a bra.

FIG. 1*a* shows a bra 10 of the present invention. The bra 10 consists of two breast cup regions 20 and 21 and a bridge region 22 between the two breast cup regions. Each of the breast cup regions 20 and 21 have respective chest band regions 23 and 24 extending therefrom. In the example shown in FIG. 1*a* the bra is a posterior opening bra. The chest band regions 23 and 24 include at their free ends, mutually cooperative clasps 26 and 27 that can be selectively engaged together. The bra of FIG. 1*a* also includes shoulder straps 28 and 29 to provide additional support and comfort for the wearer of the bra 10. However the bra of the present invention may equally be of a strapless kind where the shoulder straps 28 and 29 would be absent. The bra of the present invention may be an anterior opening bra wherein the clasps may be provided at the bridge region 22. In an anterior opening bra, there may only be one chest band that extends from and between both breast cup regions 20 and 21.

The bra of the present invention is preferably formed by molding and laminating some of the components of the bra to define the bra. Accordingly the bra of the present invention may generally be considered a molded bra although some of the components of the bra need not be subjected to molding to define their shape and form. Primarily it is the breast cup regions 20 and 21 that have their shape or form defined by a molding process. Reference to the formation of the components and subassemblies of the bra and their incorporation together to define the bra of the present invention will hereinafter be described in more detail.

Figure 2A:
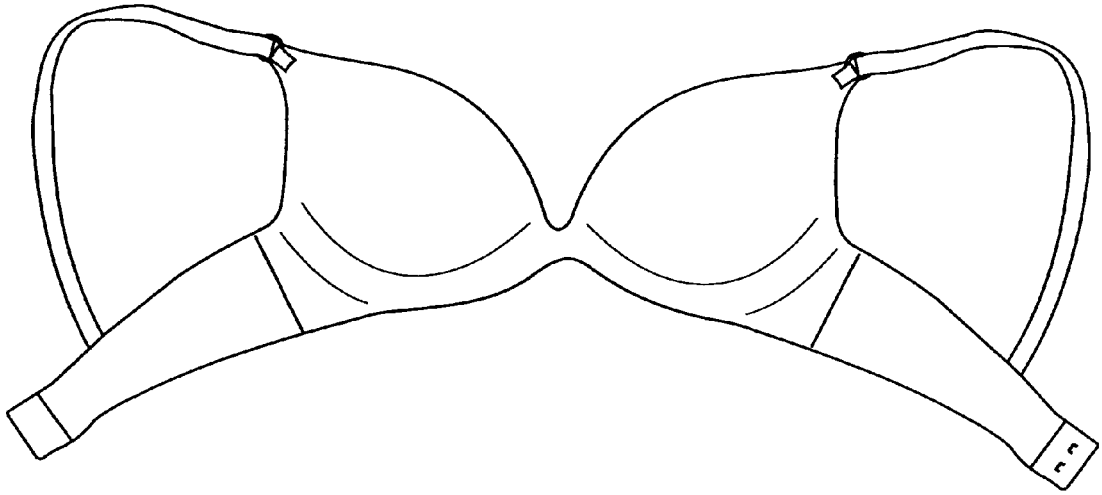
FIG. 2*a* is a back view of a bra of FIG. 1*a* wherein no hemming is provided at the perimeter of the bra.
Figure 2B:
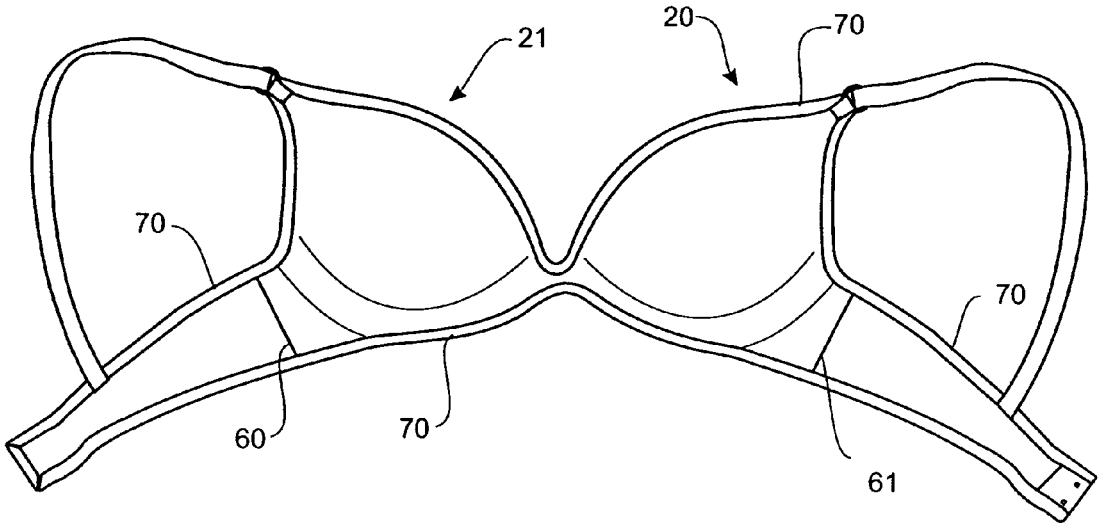
FIG. 2*b* shows a variation on the bra of FIG. 2*a* wherein there is a hem provided at least part of the perimeter of the bra.

With reference to FIG. 2*b* there is shown a rear view of a bra of the present invention, where hemming technique (as hereinafter described) is used for edge finishing of the bra. FIG. 2*a* shows an alternative to the hem finished edges where the edges are for example ultrasonically welded.

Figure 3:
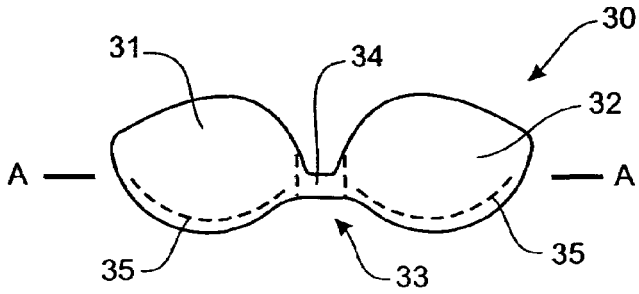
FIG. 3 is a front view of a core assembly of the bra.

The bra may be defined based around a bra core assembly 30 as shown in FIG. 3. The core assembly 30 consists of ply or plies of material that have been laminated together and molded to define two cup regions 31 and 32. These cup regions 31 and 32 may be formed from multiple overlying plies or layers of material wherein each ply or layer is continuous across the two cup regions and the bridging zone 33 of the core assembly 30. Such a core assembly is unitary. Alternatively two independent cups may be formed each by a molding of plies of material and such cups may then be connected together at the bridging zone 33. Such a core assembly is actually made from two parts connected together. Reference made herein to a core assembly includes at least these two forms of the core assembly, i.e., a unitary assembly and an assembly comprising two independent cups connected at the bridging zone 33. In the preferred form, the core assembly 30 consists of two plies of foam material laminated to each other. Within each cup region, an underwire 35 may be sandwiched between the two plies of foam material at the lower periphery of the cup region. At the bridging zone 33, a reinforcing web 34 may be provided to enhance the rigidity of the bridging zone between the two cup regions 31 and 32. The reinforcing web 34, or any flexible material in substitution thereof, is preferably substantially inelastic at least in a direction extending between the two cup regions 31 and 32 to thereby resist against a pulling away of the cup regions 31 and 32 from each other.

Figure 4:
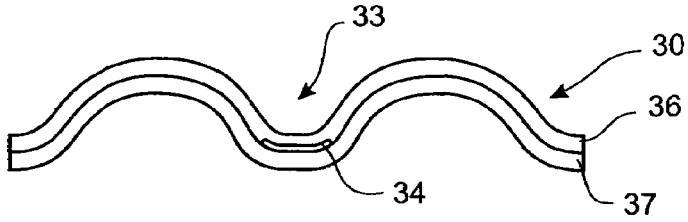
FIG. 4 is a sectional view through section AA of FIG. 3.

With reference to FIG. 4, there is shown as an example, the plies of material that can be utilised to define the core 30. With reference to FIG. 4, the core assembly 30 can be seen to consist of a ply of foam material 36 that is laminated to another ply of a foam material 37. Lamination of the two foam plies 36 and 37 may occur by use of adhesives prior to the forming of the plies to the appropriate shape and form. The plies of material may be laminated together as a layflat sheet which may then be subjected to forming by the application of pressure and/or heat by a molding device to define the cup forms in such a sheet. A perimeter shape of a kind as shown in FIG. 3 may be simultaneously or afterwards defined. Techniques for molding of moldable plies of material of which the plies 36 and 37 are made, are well known in the art. Our earlier patent application US2004/0224604 describes variations to and methods of creating the core assembly and is hereby incorporated by way of reference.

Captured intermediate of the two foam plies 36 and 37 may be the web 34 that provides reinforcing at the bridging zone 33 of the core 30.

Where reference herein is made to "inner" or "outer" or similar terms, they are understood to be in relation to the body of the wearer of the bra. For example the "innermost" or "inner side" or "inner region" is the side of the bra that is more proximate to the body of the wearer than the outer more portions/components/subassemblies of the bra.

Additional plies of material such as for example a ply of fabric material disposed to the outwardly facing side of the ply of foam material 36 and/or 37 may also be included in the core assembly 30. The incorporation of the foam plies 36 and 37 adds form and rigidity to the cup shaped regions of the bra in which the core assembly 30 is ultimately incorporated.

Figure 5:
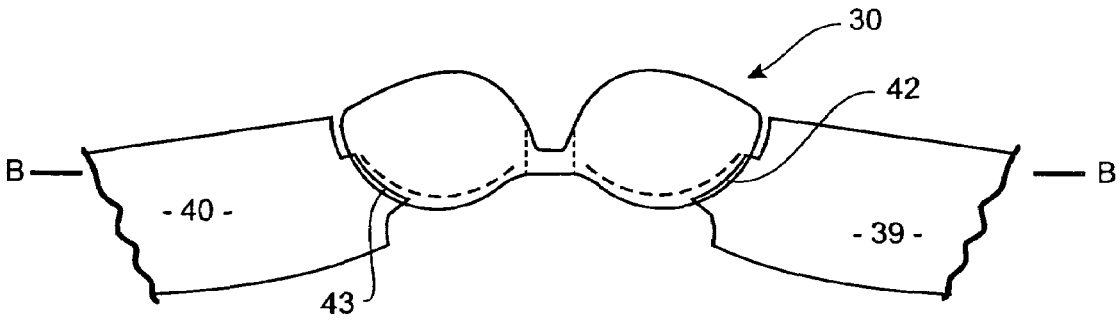
FIG. 5 illustrates a front view of the core assembly of FIG. 3 engaged to panels to define the or part of the chest band or bands of the bra.
Figure 6:
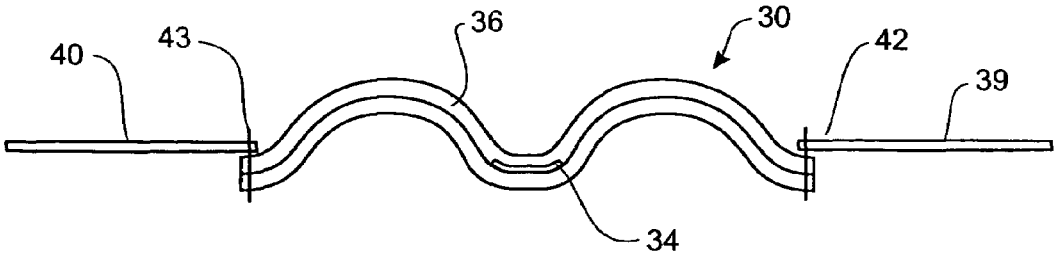
FIG. 6 is a sectional view through section BB of FIG. 5.

With reference to FIG. 5, the core assembly 30 is incorporated with panels of material 39 and 40 that go ultimately to define at least part of the chest bands 23 and 24. Each panel is preferably of a single ply or multiple plies of fabric material. The panels of material 39 and 40 are each affixed to part of the core assembly 30 at a location to allow for their ultimate defining of part of or all of the chest bands 23 and 24. As seen in FIG. 6, the panels 39 and 40 are single ply panels as seen in FIG. 6, but they each can alternatively consist of multiple plies of material. They may be covered or overlapped at least in part by other plies as well.

The panels 39 and 40 are each affixed to, preferably, the periphery or a part of the periphery of the core assembly 30. Preferably an edge region or a part of an edge region of each of the panels 39 and 40 is being affixed to the core assembly 30. The affixing may for example be achieved by lines of stitching 42 and 43. Alternative methods of affixing include, for example, ultrasonic welding or adhesive bonding or a combination of these. The panels 39 and 40 may each be a multi ply assembly of at least two overlying plies of fabric material affixed or laminated at least at some of their overlying regions to each other. These panels preferably do not include a foam ply.

In a preferred embodiment where the panels 39 and 40 are to become ultimately and predominantly exclusively the chest bands 23 and 24 of the bra, the panels 39 and 40 each consists of two plies of fabric material laminated to each other. Although one single ply of fabric material is possible for forming a chest band, its performance will unlikely be desirable in terms of stretchability (it being able to be stretched too much) and elasticity (it being not elastic enough). With two plies of fabric material, the stretchability and elasticity will be improved.

In an alternative embodiment the panels 39 and 40 may define only part of the total assembly of plies of material making up the chest bands 23 and 24 of the bra. The other part making up the chest bands 23 and 24 may be defined by one or more plies (such as plies 69 and/or 76 that are described later) that may extend across the core assembly or the cup region of the bra. For example an outermost ply of fabric material covering the core assembly may also extend across at least part and preferably all of the ply or plies making up the panels 39 and 40. In this instance, each of the panels 39 and 40 may preferably be of a single ply of fabric material although they could be of two or more plies. In effect, preferably, each chest band still comprises at least two plies of fabric material, one or more defined by the outermost ply or plies of fabric covering the core assembly and one or more defined by the panel 39 or 40 which is attached in a partially overlying manner to the core assembly 30.

Figure 7:
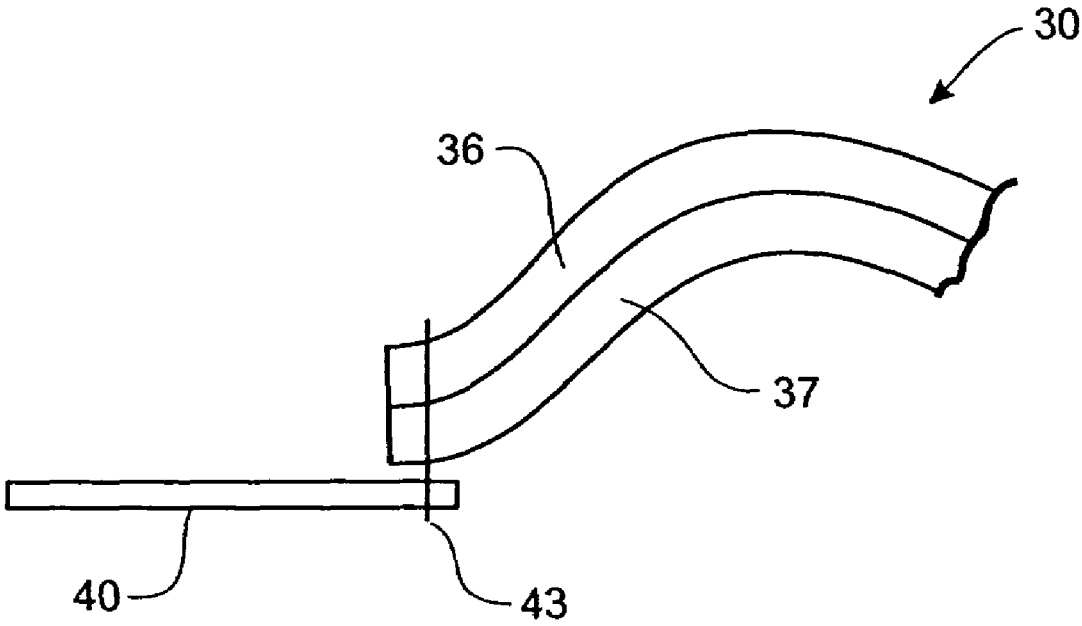
FIG. 7 illustrates part of the sectional view through BB in a slightly different configuration to that of FIG. 6.

In a preferred form an overlap between the panels 39 and 40 with the respective cup regions of the core assembly 30 to facilitate affixing occurs at the outwardly facing surface of the outermost ply of the core assembly 30 such as to the foam ply 36. With reference to FIG. 7, an alternative configuration is shown where the panel 40 is disposed to the inner most ply of the core assembly 30 such as the foam ply 37. The panels 39 and 40 are preferably oversized to an extent sufficient to allow for them to be subsequently trimmed and/or formed so that the chest bands 23 and 24 can be defined at a later stage in the process of construction of the bra. Alternatively each of the panels 39 and 40 may be of a shape that is of their final form.

Figure 8:
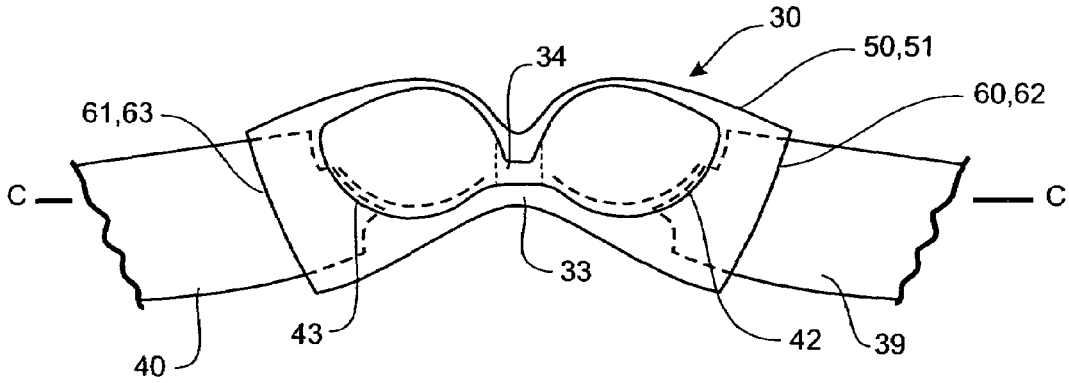
FIG. 8 is a front view of components of the assembly of a bra.
Figure 9:
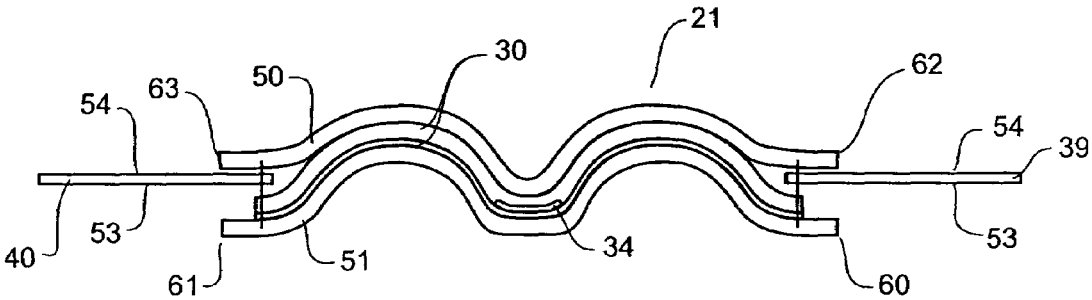
FIG. 9 is a sectional view through section CC of FIG. 8.

The core assembly 30 is preferably captured between two covering panels of material. With reference to FIGS. 8 and 9, the covering panels 50 and 51 are each disposed on the outer and inner more sides of the core assembly 30. The outer covering panel 50 is preferably contiguous the outer surface of the core assembly 30 and the inner covering panel 51 is preferably contiguous the inner surface of the core assembly 30. The covering panels 50 and 51 preferably also extend to at least in part be contiguous the inner and outer surfaces 53 and 54 of each of the panels 39 and 40 which define at least part of the chest bands 23 and 24. The covering panels 50 and 51 during the manufacture of the bra of the present invention are preferably initially of a size larger than the core assembly 30. The covering panels 50 and 51 can be subsequently trimmed to define the appropriate boundaries of the regions where such panels are provided.

The outer covering panel 50 is preferably of a multi ply assembly of fabric and foam but may be of a single ply of a fabric material. The inner covering panel 51 is similarly preferably of a multi ply assembly of fabric and foam but may similarly be of a single ply of a fabric material. Where one or both of the covering panels 50 and 51 are of the multi ply assembly the foam ply is preferably proximate more the core assembly 30 than its fabric ply.

In the most preferred form each of the covering panels 50 and 51 consists of a ply of fabric material laminated to a ply of foam material.

The covering panels 50 and 51 are preferably adhesively laminated to the respective face sides of the core assembly 30 and to part of the panels 39 and 40. Such adhesive lamination preferably may also include the application of a molding force and pressure and temperature in order to encourage the covering panels 50 and 51 to be formed to the desired and appropriate cup forms.

The outer covering panel 50 and inner covering panel 51 may be heat bonded during its molding step to the core assembly 30 and to part of the panels 39 and 40 or alternatively or in addition an adhesive may be utilized to encourage their lamination with the core assembly 30 and to part of the panels 39 and 40.

One or both of the covering panels 50 and 51 preferably each extends over and on each side of the lines of stitching 42 and 43 to obscure this region from view on one or both of the inner side and outer side of the bra. In the preferred form where a foam ply of the covering panel 50 or 51 is contiguous a surface of the core assembly 30, the foam ply helps make the boundary of the core assembly 30 or at least part of the boundary less conspicuous.

One or both of the covering panels 50, 51 may also extend to cover the entirety of the panels 39 and 40, but their primary function is to cover the seams 42 and 43 (if present) or any other attaching means attaching the panels 39 and 40 to the core assembly 30, to prevent them from being visible on the inner side and/or outer side of the bra.

Preferably the number of plies constituting the chest band is two and preferably there is no foam in the chest band other than because of the slight overlap of the covering panels 50, 51 (which may include foam) adjacent the seams 42 and 43 (if present).

Figure 1B:
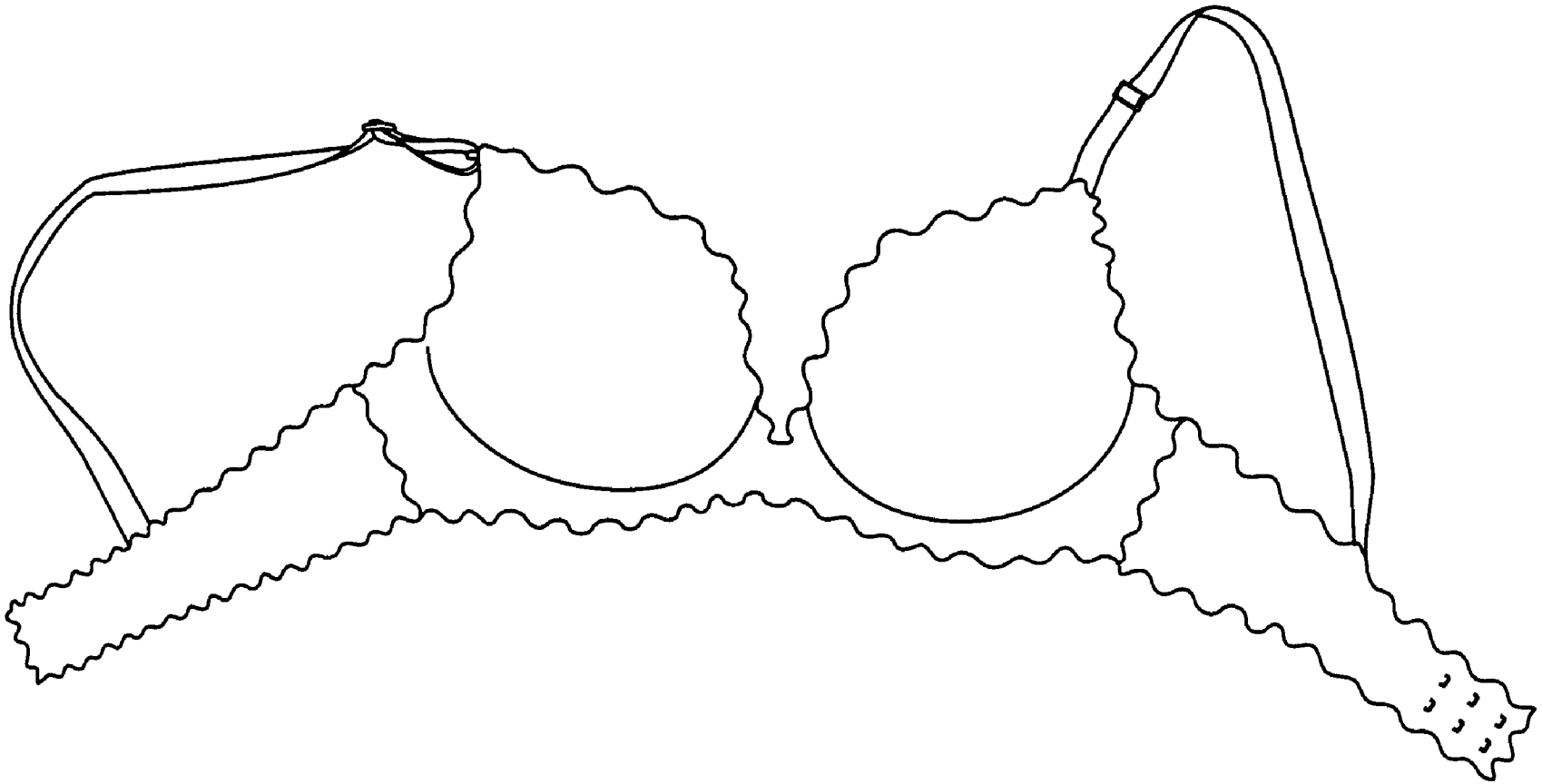
FIG. 1*b* is a front view of a bra with an alternative edge finish to that of the bra of FIG. 1*a*.
Figure 10:
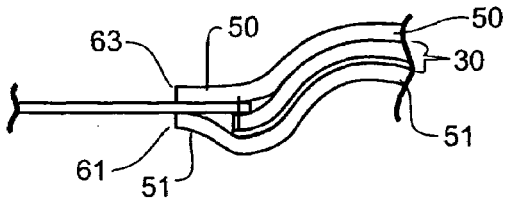
FIG. 10 illustrates part of the region of the section of FIG. 9 illustrating the assembly of the plies of material.
Figure 11:
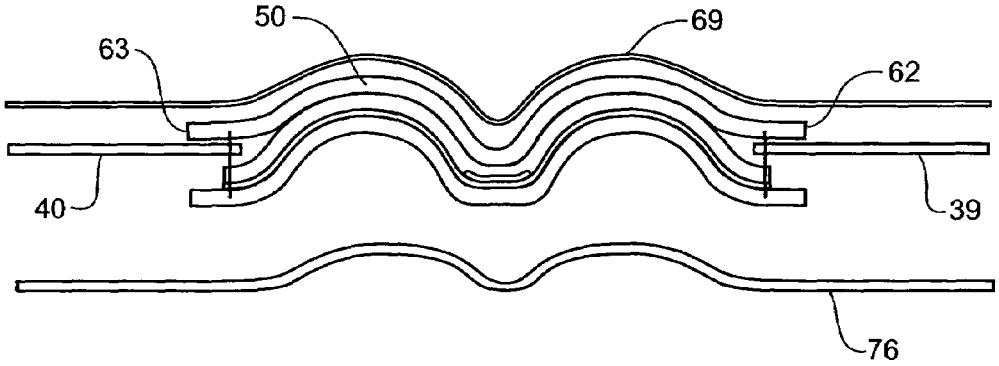
FIG. 11 illustrates optional further ply or plies or assembly of plies that can be engaged to the resultant assembly of FIG. 9.

In a preferred form the inner covering panel 51 has an edge 60 and 61 at each of the panels 39 and 40 which each extends across the panels 39 and 40 respectively. The edges may be straight or curved, scalloped (as shown in FIG. 1*b*) or otherwise non-straight. Likewise in a preferred form the outer covering panel 50 has an edge 62 and edge 63 at each of the panels 39 and 40 respectively which each extends across the panels 39 and 40 respectively. The edges may again be straight or curved, scalloped or otherwise non-straight. The edges 60, 62 and 61, 63 may be parallel each other or not, or juxtaposed each other or not. The view of the edges 60 and 61 of the inner panel 51 as shown in FIG. 9 is a slightly exploded view in that the panel 51 at edge 61 or 60 actually does come into contact with and is preferably affixed to the inner face 53 of each of the panels 39 and 40. This contact is shown to have been made in FIG. 10.

With reference to FIG. 1*a*, the edges 62 and 63 are shown to be visible to the exterior of the bra. The inner and/or outer covering panel 50, 51 may alternatively be contiguous the entire chest bands in which case no such edges 63,64 and/or 60,61 will be present across the chest bands.

In an optional variation to the present invention, an outermost ply 69 may be applied over the outer covering panel 50 and overlaps at least in part and preferably all of the outwardly facing surface 54 of each of the panels 39 and 40. In the process of manufacture, the outermost ply 69 is preferably a ply of fabric material which is contiguous and applied against the covering panel 50 and each of the panels 39 and 40 on at least their exposed outwardly facing surfaces. With the application of the outermost ply 69, the edges 62 and 63 become obscured.

An innermost ply 76 may also be applied to the inner facing surfaces of the inner covering panel 51 and panels 39 and 40. The finishing ply 69 and/or 76 may be applied by adhesive lamination and/or the application of pressure and heat and/or molding to become appropriately affixed.

The outermost ply 69 may be of a size sufficient to allow for a hem 70 to be formed about a substantial portion of the perimeter of the bra. The hem is preferably formed on the inward side of the bra at a substantial portion of the perimeter of the bra as shown with reference to FIG. 2*b*. The hem may be formed by a folding of the peripheral region of the outermost ply 69 about the edge of the panels and plies to which it is applied and to thereby "seal" the edge of the bra to prevent exposure of the foam panel of the core assembly 30 and exposure of any of the other plies of material at their edges. The folded-over region is preferably affixed to the panel or ply to which it is attached by a non-stitch means such as by use of adhesive film. The folded-over region may also be stitched down to the panel or ply to which it is attached but such is not preferred. The part of the outermost ply 69 which is not folded over may remain loose with respect to the panel or ply against which it is positioned or alternatively be affixed to it.

The above described hemming technique and/or the outermost ply 69 do not need to apply to the whole bra. It is possible that the hem and/or the outermost ply 69 cover only the covering panels 50, 51 where these include foam.

Hemming technique as described herein is one way of edge finishing of a seamless bra for which the conventional seams are eliminated or substantially eliminated. Alternative edge finishing of the bra can be achieved including that by ultrasonic sealing as per the bra shown in FIG. 2*a*, overlock stitching or by the application of a piping or strip or strips of materials to define a hem. Where no outermost ply is provided to cover the covering panel 50, the edges of the bra at where the covering panels 50 and 51 are present are preferably ultrasonically sealed to conceal the foam of the covering panels at the edges, when one or both of the covering panels include a foam ply. Where one (preferably the outer covering panel) of the covering panels is only of a fabric ply, that fabric ply can be of a size sufficient to establish a hem at least part of the edge of the bra.

The foam material described herein may be polyurethane or memory foam or other suitable foam material. The fabric material described herein may be nylon or spandex or other suitable fabric material.

One advantage of the present invention is that a separately produced chest band that is to be attached to the core assembly can easily have any "special effects" added to it—e.g., different patterns, colors, materials, etc., from the inner and outer layers encasing the core assembly—before attachment to the core assembly is effected, thereby increasing the flexibility in the design of for example the appearance of the ultimate bra product.

Another advantage is that where a bra includes a foam-based core assembly as described herein, its chest band substantially containing no foam material is made possible by this invention.

While the present invention has been described with reference to particular embodiments thereof, it will be understood that such embodiments are susceptible of modifications and variations without departing from the scope of the present invention and that the invention will include all embodiments falling within the scope of the appended claims.

What is claim is:

1. A brassiere comprised of:

two breast cup regions, a bridge region between the two breast cup regions, and a chest band which comprises at least one ply of a first material and which extends from at least one of the two breast cup regions, the brassiere further assembly includes:

a. a core assembly which substantially defines the two breast cup regions and the bridge region, the core assembly comprising at least an inner ply of molded foam material over the breast cup regions and over the bridge region and an outer ply of molded foam material laminated with the inner ply of molded foam material over the breast cup regions and the bridge region;

b. the at least one ply of a first material of the chest band is affixed to a part of the core assembly; and c. a ply of a second material which is affixed to and overlaps at least a part of the core assembly including the region where the at least one ply of a first material is affixed to the core assembly.

2. A brassiere as claimed in claim 1 wherein the ply of a second material extends across less than the entire length of the chest band away from the at least one breast cup region.

3. A brassiere as claimed in claim 1 wherein the ply of a second material extends across at most one-half of the entire length of the chest band away from the at least one breast cup region.

4. A brassiere as claimed in claim 1 wherein the ply of a first material comprises at least one ply of fabric material.

5. A brassiere as claimed in claim 1 wherein the ply of a first material is exclusively fabric material.

6. A brassiere as claimed in claim 1 wherein the core assembly has a periphery and the ply of a first material is affixed to the core assembly at a part of the periphery of the core assembly.

7. A brassiere as claimed in claim 1 wherein the ply of a first material has an edge and is affixed to the core assembly at least near to the edge of the ply of a first material.

8. A brassiere as claimed in claim 1 wherein the ply of a first material is affixed to the core assembly by stitching.

9. A brassiere as claimed in claim 1 wherein the ply of a first material is affixed to the core assembly by an adhesive means.

10. A brassiere as claimed in claim 1 wherein the ply of a first material is affixed to the core assembly by means of heat or ultrasonic welding.

11. A brassiere as claimed in claim 1 wherein the breast cup regions are seamless.

12. A brassiere as claimed in claim 1 wherein the core assembly is seamless.

13. A brassiere as claimed in claim 1 wherein the core assembly further comprises an underwire sandwiched between the inner ply of molded foam material and the outer ply of molded foam material at the lower peripheral region of a breast cup region.

14. A brassiere as claimed in claim 1 wherein the ply of a first material comprises two contiguous plies of fabric material substantially laminated with each other.

15. A brassiere as claimed in claim 1 wherein two plies of a first material are provided, each affixed to a respective breast cup region of the core assembly, each of the plies of a first material includes a free end that carries a clasp to cooperate with the clasp of the other of the plies of a first material to join the two first plies of a first material together to in use hold the brassiere to the chest of the user, and wherein the ply of the second material overlaps at least a part of each of the plies of a first material including the region where each ply of a first panel material is affixed to the core assembly.

16. A brassiere as claimed in claim 1 wherein the core assembly has an outer side and an inner side which is toward a wearer; two of the plies of a second material of which one is affixed to the outer side of the core assembly and the other is affixed to the inner side of the core assembly.

17. A brassiere as claimed in claim 1 wherein the ply of a second material comprises at least one ply of fabric material.

18. A brassiere as claimed in claim 1 wherein the ply of a second material comprises a foam ply, and a fabric ply laminated with the foam ply, wherein the fabric ply is positioned more distal to the core assembly than the foam ply.

19. A brassiere as claimed in claim 1 wherein the core assembly has an inner side toward a wearer and an outer side, and the ply of a second material overlaps the entire inner or outer side of the core assembly.

20. A brassiere as claimed in claim 1 wherein the ply of a second material is laminated to the core assembly where the ply of a second material overlaps the core assembly.

21. A brassiere as claimed in claim 1 wherein the brassiere has an outer side away from a wearer on which the ply of a second material is positioned.

22. A brassiere as claimed in claim 1 wherein the brassiere has an inner side toward a wearer on which the ply of a second material is positioned.

23. A brassiere as claimed in claim 1 wherein the brassiere has a peripheral edge including a substantial portion thereof which is ultrasonically welded.

24. A brassiere as claimed in claim 1 wherein the brassiere has an outer side away from a wearer and an outermost ply of fabric material is disposed to the outer side of the brassiere and extends across both the core assembly and the ply of a first material.

25. A brassiere as claimed in claim 24 wherein the brassiere has an inner side toward the wearer, and the outermost ply of fabric material is affixed to the inner side of the brassiere by an edge of the outermost ply being folded and the folded-over edge being affixed to the inner side of the brassiere.

26. A brassiere as claimed in claim 25 wherein the folded-over edge is affixed to the inner side of the brassiere is by adhesive means.

27. A brassiere as claimed in claim 1 wherein the brassiere has an inner side toward a wearer and an inner most ply of fabric material is disposed to the inner side of the brassiere and extends across both the core assembly and the ply of a first material.

28. A brassiere as claimed in claim 1 wherein the core assembly is a unitary assembly.

29. A brassiere as claimed in claim 1 wherein the core assembly is of two parts, each part defining one of the breast cup regions and the parts being connectable together at the bridge region, wherein the brassiere so defined is of a front opening kind.

30. A brassiere which comprises two molded and seamless breast cups and at least one chest band to hold the bra to a user of the brassiere, wherein the chest band includes at least one panel of material which is affixed to one or both of the breast cups while the chest band panel of material does not extend across any part of the molded and seamless breast cups.

* * * * *